US007055651B2

(12) United States Patent
Klingler

(10) Patent No.: US 7,055,651 B2
(45) Date of Patent: Jun. 6, 2006

(54) BELAY DEVICE

(75) Inventor: Gregory Lee Klingler, Denver, CO (US)

(73) Assignees: Simple Little Gizmos LLC, Denver, CO (US); Faders, SA, Barcelona (ES)

( * ) Notice: Subject to any disclaimer, the term of this patent is extended or adjusted under 35 U.S.C. 154(b) by 318 days.

(21) Appl. No.: 10/741,350

(22) Filed: Dec. 22, 2003

(65) Prior Publication Data

US 2005/0051385 A1 Mar. 10, 2005

Related U.S. Application Data

(60) Provisional application No. 60/501,311, filed on Sep. 9, 2003.

(51) Int. Cl.
*A62B 1/00* (2006.01)

(52) U.S. Cl. ..... 182/5; 182/193

(58) Field of Classification Search ..... 182/5, 182/192, 193; 188/65.4, 65.5
See application file for complete search history.

(56) References Cited

U.S. PATENT DOCUMENTS 641,809 A * 1/1900 Tillottson ..... 188/65.5
4,333,551 A * 6/1982 Shefrin ..... 188/372
4,531,610 A 7/1985 Fertier et al. ..... 182/5
4,883,146 A * 11/1989 Varner et al. ..... 182/5
5,217,092 A 6/1993 Potter ..... 188/65.4
5,360,083 A * 11/1994 Hede ..... 182/5
5,577,576 A 11/1996 Petzl et al. ..... 188/65.4
5,597,052 A 1/1997 Rogleja ..... 188/65.5
5,671,822 A 9/1997 Phillips ..... 182/5
D413,786 S 9/1999 Graham ..... D8/356
6,843,346 B1 * 1/2005 LeBeau et al. ..... 182/5

* cited by examiner

*Primary Examiner*—Alvin Chin-Shue

(57) ABSTRACT

An improved Belay Device is provided consisting of a Base (14), Rope Locking Ring (36), Cover (48), and Connecting Pin (58). The Base (14) contains a Protruding Cylindrical Core (18) with a Base Rope Channel (20). The Protruding Cylindrical Core (18) is received within a Central Hole (34) of the Rope Locking Ring (36). The Rope Locking Ring (36) contains an Upper Ring Rope Channel (38) and Lower Ring Rope Channel (40) that, in normal operating configuration, align with the Base Rope Channel (20) thus forming one continuous rope channel. An abrupt force on a rope passing through the device causes the Rope Locking Ring (36) to rotate with respect to the Protruding Cylindrical Core (18) thus destroying the alignment of the Lower Ring Rope Channel (40), Base Rope Channel (20), and Upper Ring Rope Channel (38). The rope thus becomes pinched or locked in the transition regions between these rope channels. The rope may be released by exerting pressure on a Handle (44) extending outward from the Rope Locking Ring (36). The improved Belay Device has a rope path which passes directly through the axis of rotation of the Rope Locking Ring (36). Relative to the prior art, this feature offers the capability to have a smaller distance between the axis of rotation and the rope pinch area, thus providing greater leverage.

16 Claims, 6 Drawing Sheets

BELAY DEVICE

CROSS-REFERENCE TO RELATED APPLICATIONS

Figure 1:
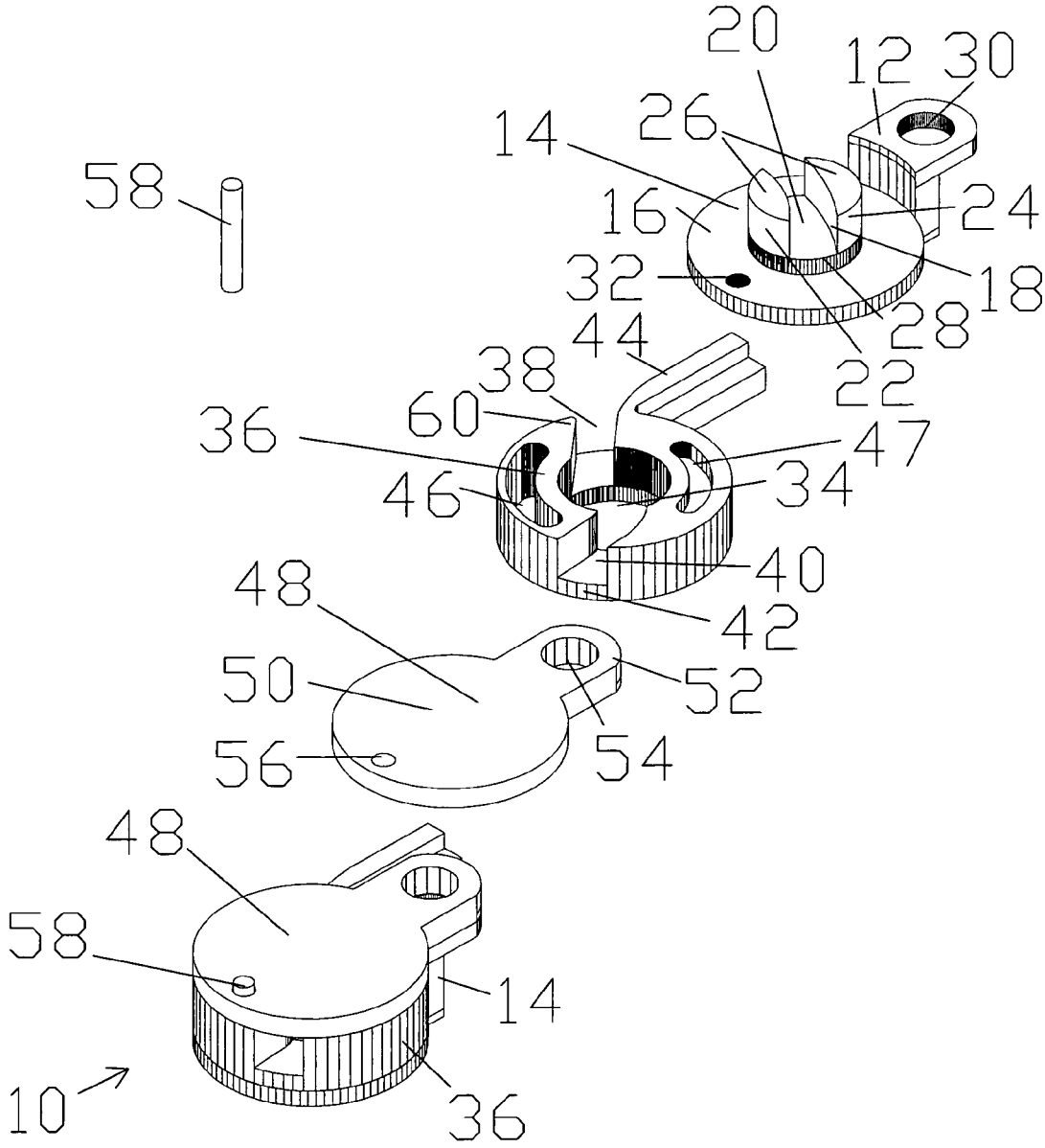

Provisional application No. 60/501,311 filed on Sep. 9, 2003.

STATEMENT REGARDING FEDERALLY SPONSORED RESEARCH AND DEVELOPMENT

Not applicable.

BACKGROUND—FIELD OF INVENTION

This invention pertains to a device used, in conjunction with a rope, to stop a falling object and/or to lower an object in a controlled manner. In particular it pertains to a belay device used in the sport of rock climbing and, more specifically, to an auto-locking belay device.

BACKGROUND—DESCRIPTION OF PRIOR ART

In the sport of rock climbing, a belay device is used to protect a climber from injury in the case of a fall. Generally the climber wears a harness to which one end of a rope is attached. The rope passes through a belay device that is often attached to the harness of another person, the "belayer". The belayer operates the belay device and typically remains at a stable point while the climber ascends. When the climber is "lead" climbing, the climber drags the rope up the rock as he ascends. At various points during the ascent, the climber clips the rope into metal loops (carabiners) that, in turn, are attached to the surface of the rock. When the climber is "top-rope" climbing, the rope extends down toward the climber from above. In the case of lead climbing, the belayer feeds out rope as the climber ascends. In the case of top-rope climbing, the belayer takes in rope as the climber ascends. In either case, if the climber falls, the belayer must grasp the rope securely by means of the belay device. The fall is therefore stopped by means of the belay device and the climber comes to rest suspended from above by the rope. Thereafter, the belayer may gently lower the climber to the ground by operating the belay device so as to gradually release tension on the rope. Anyone experienced in rock climbing is familiar with this practice and with the various forms of belay devices.

As mentioned, when lead climbing the rope is fed out from the belay device to the climber. If the climber is in a precarious position, he may need to quickly clip the rope into an attachment point In order to accomplish this move, the climber may require that as much as eight feet of rope be fed through the belay device almost instantly. When the climber is not able to obtain sufficient rope in one quick fluid movement, the climber is said to have been "short-roped". Short-roping can actually cause the climber to fall by disturbing his balance. Since the primary objective of a belay device is to stop the fall of a climber, most devices contain a torturous path through which the rope runs. The frictional forces that develop as the rope travels through this torturous path serve to oppose the movement of the rope. This effect is beneficial to stop a fall but in direct opposition to the requirement that at times rope must be fed very quickly to the climber when he is lead climbing.

Over the years many devices have been developed to grip a rope and to control the rate of movement of rope, and many of these devices have been used for the purpose of belaying or for the very similar purpose of descending. Much of the patented prior art deals with descenders, many of which can also be used as belay devices. A descender is designed to lower a person or object in a controlled fashion.

The devices of the prior art can be broadly categorized into two classes:

The first class, manual belay devices, consists of relatively simple devices that contain no moving parts. These devices, many of which are very effective, rely entirely upon frictional forces developed within a torturous path through which the rope runs. A positive attribute of this class is that these devices are inexpensive since they are based on simple designs and contain no moving parts. On the negative side, these devices require action on the part of the belayer in order to stop a fall. If the belayer is inattentive or looses his grip, the result can be disastrous. Also on the negative side, it is difficult to feed rope quickly through these devices due to the torturous path of the rope. Examples include U.S. Pat. No. D413,786 to Graham, U.S. Pat. No. 5,217,092 to Potter, and U.S. Pat. No. 5,671,822 to Phillips.

The second class, auto-locking belay devices, consists of relatively more complicated designs, often with moving parts, that have the benefit of requiring no action on the part of a belayer in order to stop a fall. Often, such devices consist of one or more cams over which the rope runs. The cams either have an off-center axis of rotation or a variable radius that increases as the cam rotates. At least one such cam in each such device is usually designed such that, under normal climbing conditions, the rope slips over the surface of the cam and the cam remains stationary but, in the event the climber falls, the friction developed by the rapid passage of the rope along the cam surface causes the cam to rotate. Due to the shape of the cam, rotation thereof causes the rope to be pinched and stops the rope. These rotating cams are often spring loaded so as to resist rotation until a certain threshold frictional force has been achieved. A positive attribute of this class is that these devices require little or no action on the part of the belayer in order to stop a fall. On the negative side, these devices are relatively more expensive since they are more complicated designs and often have multiple moving parts. The presence of a moving part usually implies the requirement for manual labor in the assembly of that part which, in turn, implies relatively higher manufacturing cost Another negative attribute of this class, as with the first class, is that it can be difficult to feed rope quickly through these devices. The rapid pull of rope through the device, in essence, simulates the same conditions on the device as a fall, thus causing the cam to rotate and lock the rope. Examples of these auto-locking devices include U.S. Pat. No. 4,531,610 to Fertier et. al., U.S. Pat. No. 5,360,083 to Hede, U.S. Pat. No. 5,577,576 to Petzl et al., and U.S. Pat. No. 5,597,052 to Rogleja.

The devices described in the above mentioned patents, do not disclose, teach or illustrate the unique structure, function and advantage of the subject belay device.

The belay device and the belayer are critical to the sport since a climber's life is dependent both on the ability of the device to do its job and the attentiveness and reactions of the belayer. Some ideal characteristics of a belay device are:

It should be simple to operate. A device that is simple to operate allows the belayer to pay more attention to the climber and less to the operation of the device.

It should be strong, yet lightweight and small. Since climbers often have to carry a substantial amount of equipment, weight and size are important factors.

It should grip the rope very tightly when the climber falls. Sometimes climbers fall from heights significantly above their last rope attachment point. The device must be able to stop a heavy climber who has been in a free fall.

It should allow easy passage of the rope as the climber is climbing. This feature helps to prevent the occurrence of short-roping.

It should render the climber in a safe position should the belayer accidentally loose his grip either on the device itself or on the rope.

It should allow for the belayer to easily lower the climber in a controlled fashion.

Its manufacturing costs should be such that it is affordable.

It should not cause undue wear on the rope.

These desired attributes can lead to design features that are in conflict with each other. For example:

a very strong device might be too large or too heavy;

a device that grips the rope very tightly might not allow the belayer to easily lower the climber, a device that grips the rope very tightly might cause excessive wear on the rope;

a device that allows easy passage of the rope might not grip the rope sufficiently tightly when a climber falls;

a device which renders the climber in a safe position even if the belayer looses his grip, might have excessive manufacturing costs due to greater complexity.

SUMMARY

The essence of the present invention is an improved belay device, for use in the sport of rock climbing, which performs well with respect to all critical characteristics. The subject invention achieves an optimal balance of these critical design characteristics.

OBJECTS AND ADVANTAGES

In view of the foregoing, it is a primary object of the present invention to provide a belay device that achieves an optimal balance of desired performance characteristics that can often be in conflict with one another. Of particular note is the fact that this device is small, able to grip the rope very firmly, yet requires minimal force to lower a climber in a controlled fashion.

Another object is that the device requires little or no action on the part of the belayer in order to stop a fall. If the belayer releases his grasp on the present invention altogether, a fall will be stopped. Alternatively, the belayer may continue to hold the device during a fall, provided he does not obstruct the movement of the rope locking mechanism.

Still another object is that the device is inexpensive relative to its performance features. The present invention contains only one simple moving part It has a rope locking ring which can rotate around a central axle. It has no elaborate cams of varying radius. As will become apparent when reviewing the included figures, the hole through which a carabiner is received during operation, also serves to secure a front face plate.

Still another object is that the device provides a simple means for a fallen climber to be lowered to the ground in a gradual and controlled fashion. With the present invention, the belayer may lower a climber simply by exerting a relatively small force on a small, yet comfortable, lowering handle; the rate of descent being in direct proportion to the force exerted by the belayer.

Still another object is that the device grips a rope securely, even in the case of a fall of a heavy climber.

Still another object is that the device does not cause undue wear on a rope. The path of the rope through the present invention contains only smooth surfaces and all turns are of gradual curvature. The device contains no teeth or rough surfaces with which to grip the rope.

Still another object is that the device is relatively small and lightweight.

Still another object is that the device contains a relatively smooth rope path that allows the belayer to feed out rope very quickly.

These and other objects of the subject invention will become apparent to those familiar with the different types of belay devices when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

DRAWING FIGURES

FIG. 1 presents an exploded view of a Primary Embodiment Belay Device.

Figure 2:
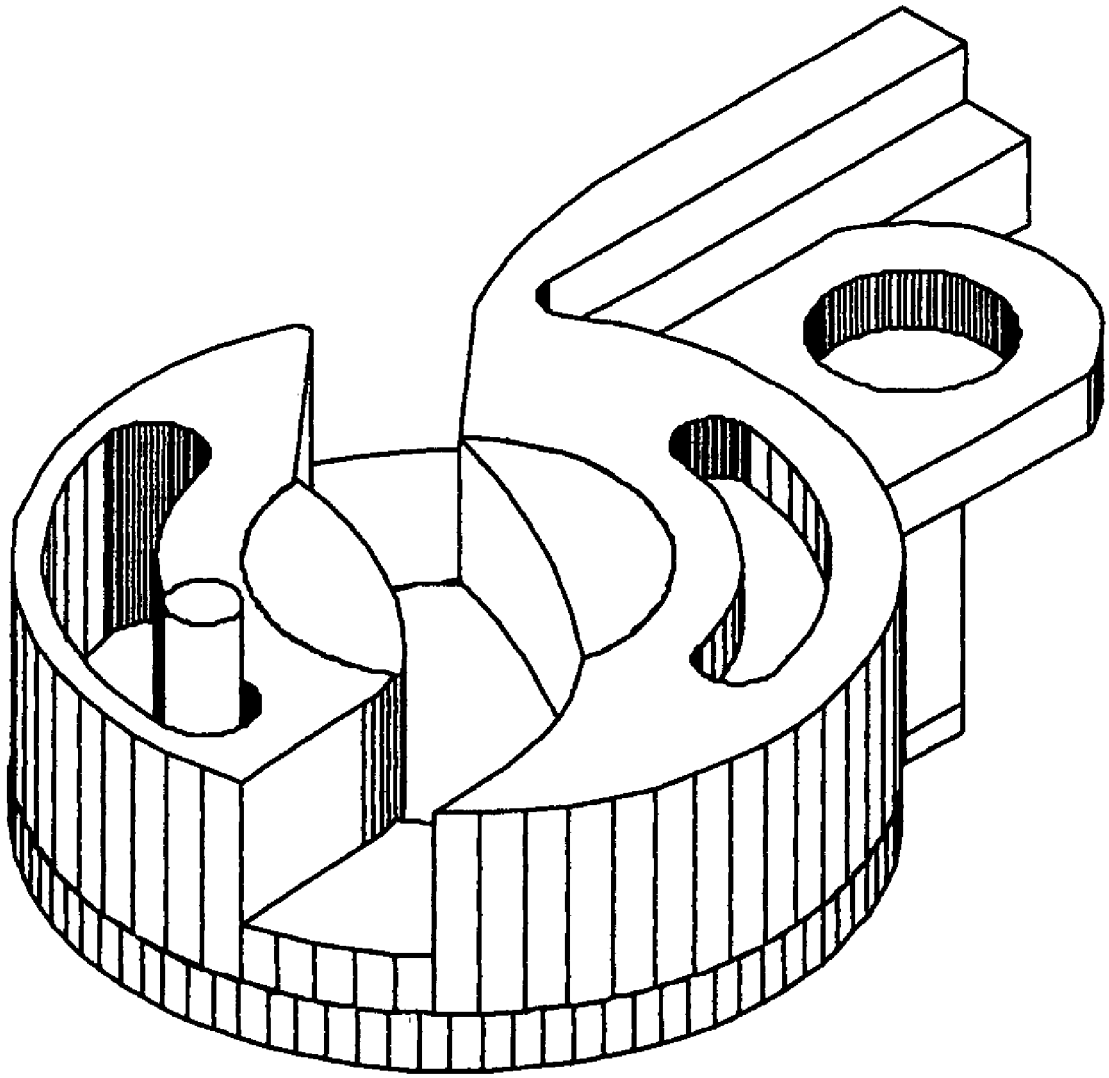

FIG. 2 presents the Primary Embodiment Belay Device without its Cover, exposing the internal components and demonstrating how they fit together.

Figure 3:
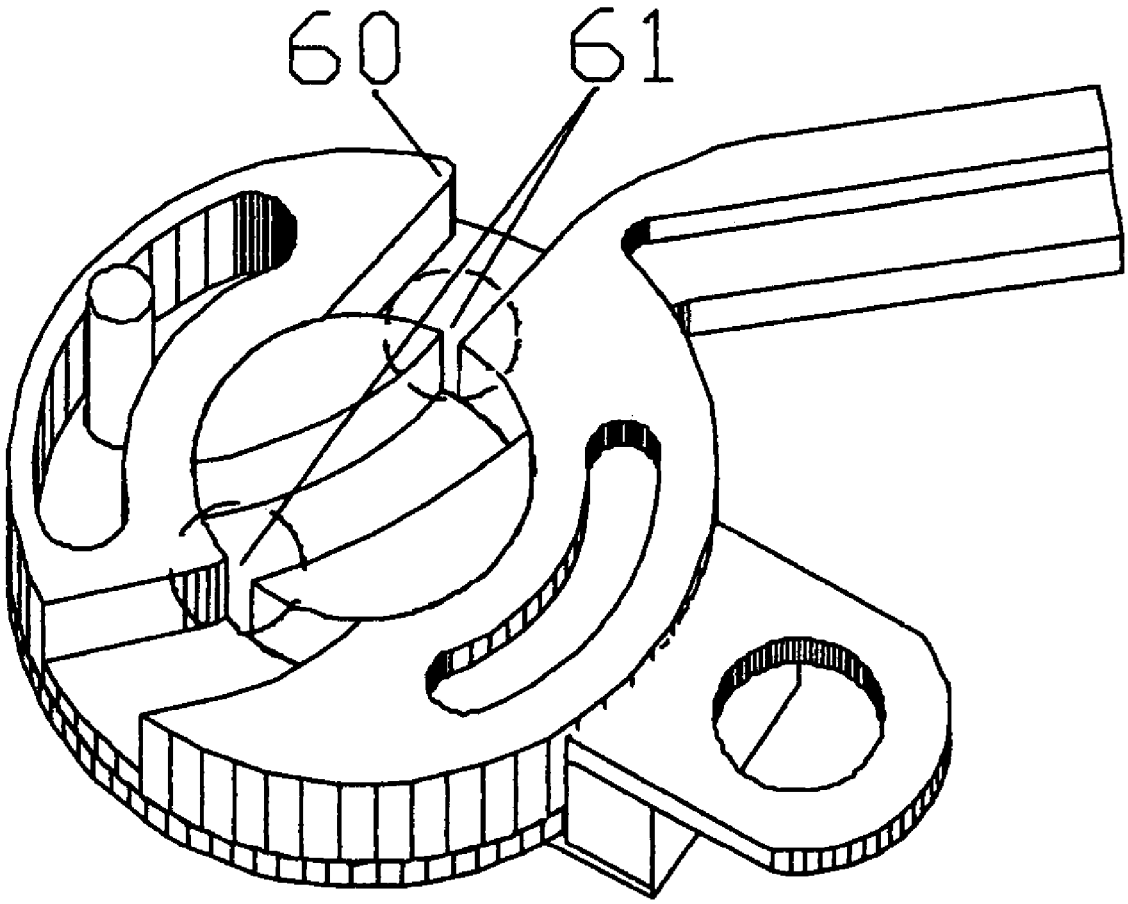

FIG. 3 shows the configuration of the Primary Embodiment Belay Device, without the Cover, after it has locked a rope.

Figure 4:
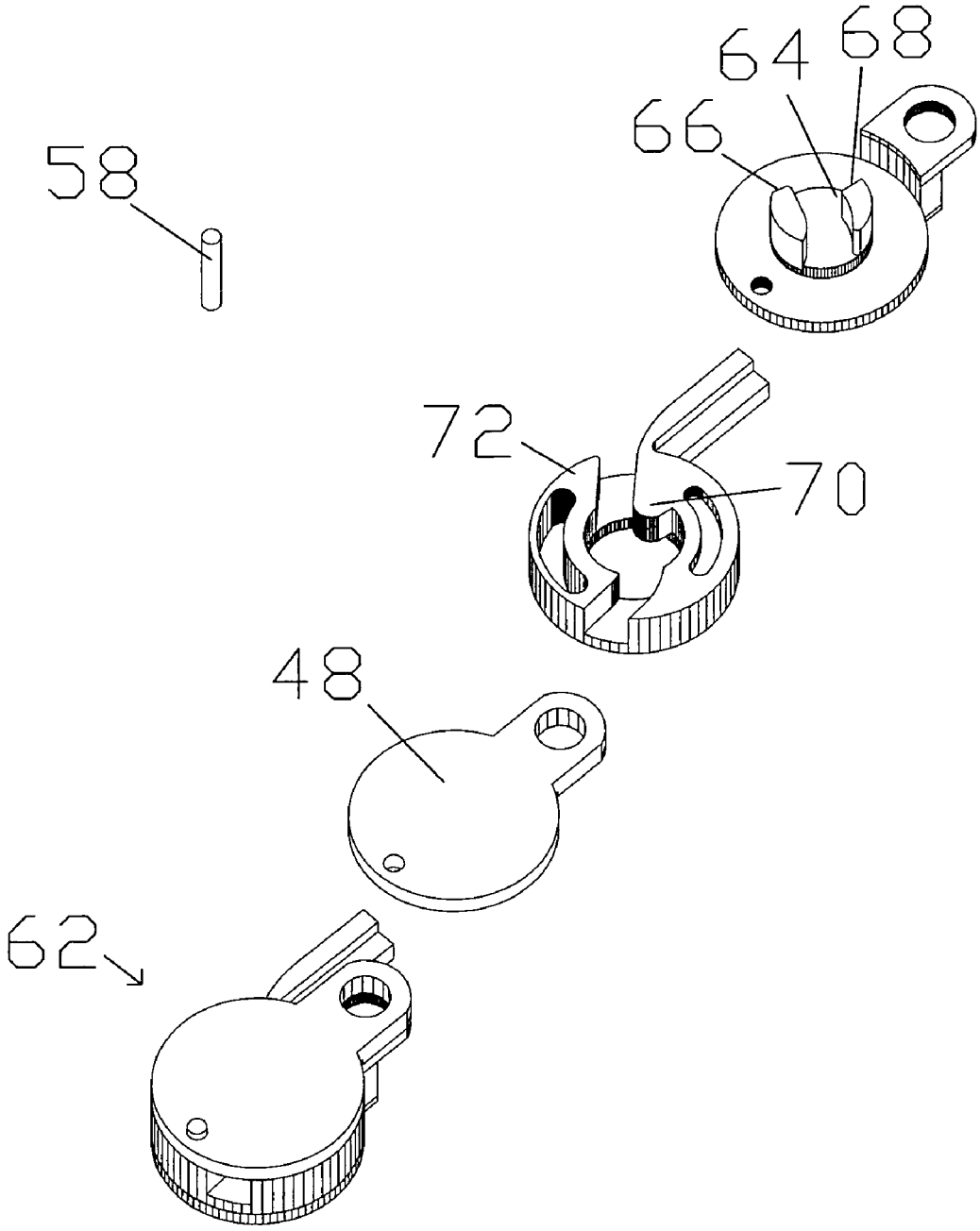

FIG. 4 presents an exploded view of an Alternate Embodiment Belay Device that, relative to the Primary Embodiment Belay Device, is less harsh on a rope while achieving greater rope pinch force.

Figure 5:
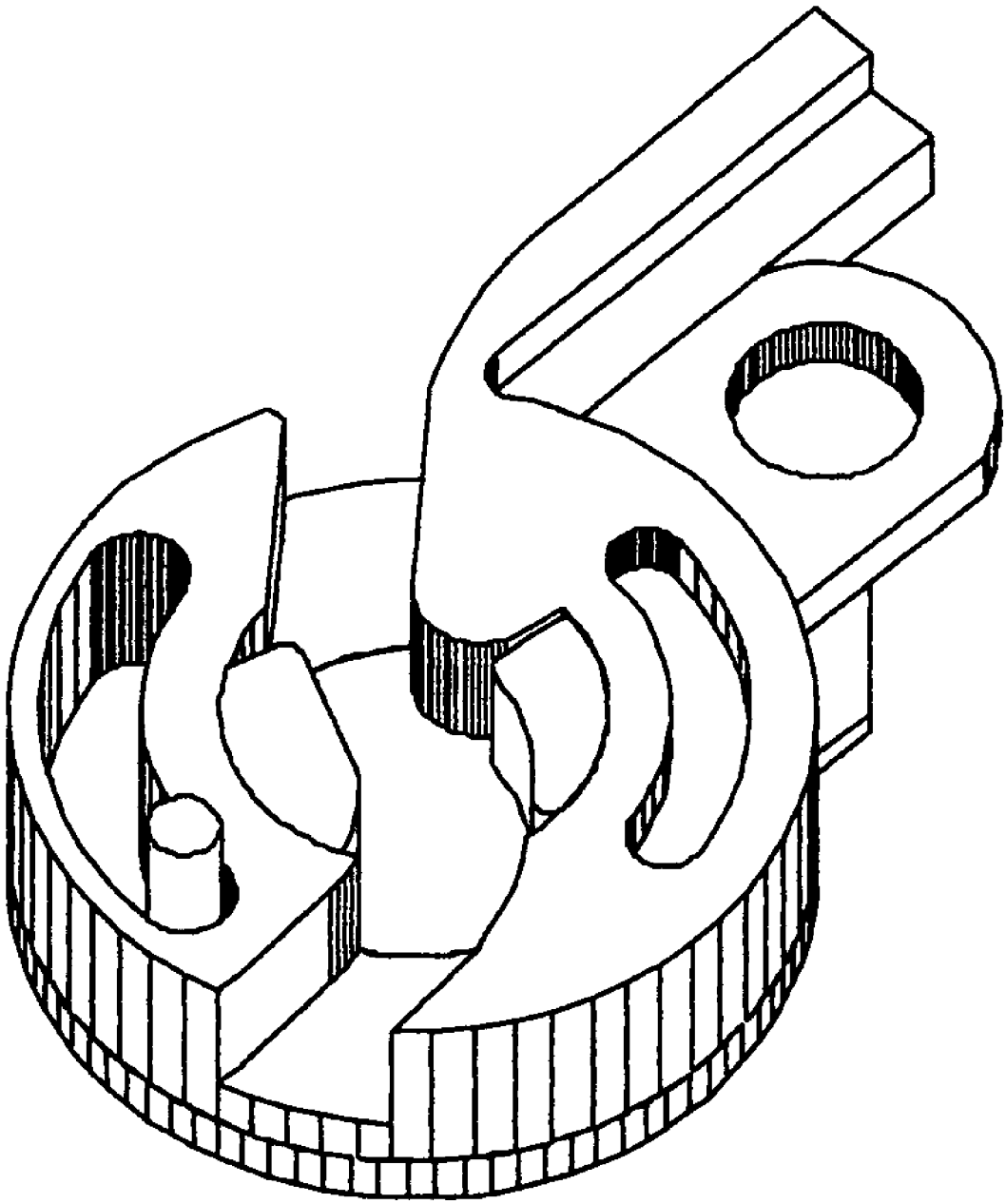

FIG. 5 presents the Alternate Embodiment Belay Device without its Cover, exposing the internal components and demonstrating how they fit together.

Figure 6:
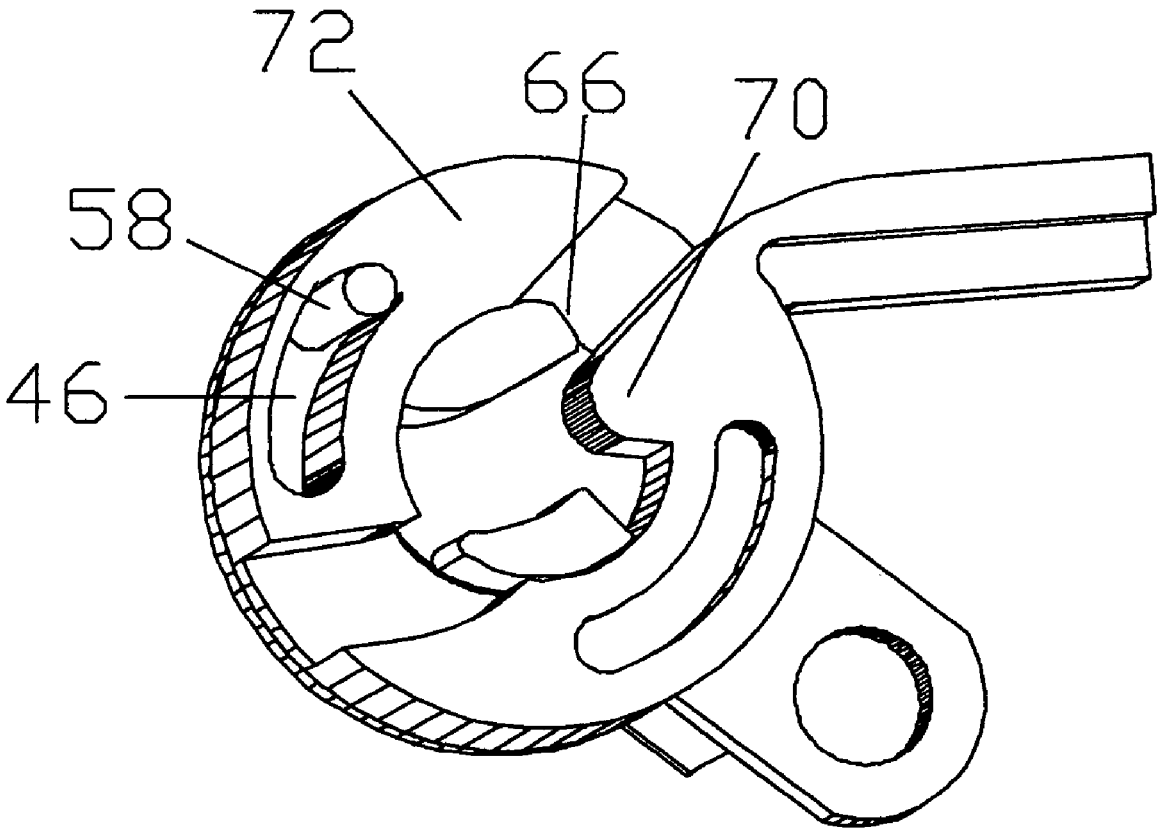

FIG. 6 shows the configuration of the Alternate Embodiment Belay Device, without its Cover, after it has locked a rope.

REFERENCE NUMERALS IN DRAWINGS

10 Primary Embodiment Belay Device
12 Base Carabiner Attachment Arm
14 Base
16 Circular Plate
18 Protruding Cylindrical Core
20 Base Rope Channel
22 Base Rope Channel Left Wall
24 Base Rope Channel Right Wall
26 Axle Top Face
28 Back Axle Portion
30 Base Carabiner Hole
32 Base Connecting Pin Hole
34 Central Hole
36 Rope Locking Ring
38 Upper Ring Rope Channel
40 Lower Ring Rope Channel
42 Continuous Ring
44 Handle
46 Curved Channel

47 Recessed Area
48 Cover
50 Circular Cover Plate
52 Cover Carabiner Attachment Arm
54 Cover Carabiner Hole
56 Cover Connecting Pin Hole
58 Connecting Pin
60 Upper Ring Rope Channel Left Side
61 Rope Pinch Transition Regions
62 Alternate Embodiment Belay Device
64 Back Axle Portion Front Face
66 Base Rope Channel Left Top Surface
68 Base Rope Channel Right Top Surface
70 Rope Locking Arm
72 Alternate Rope Locking Ring

DESCRIPTION AND OPERATION

FIG. 1 presents an exploded view of a Primary Embodiment Belay Device (10). A Base Carabiner Attachment Arm (12) is affixed to a Base (14). The Base (14) comprises a Circular Plate (16) with a Protruding Cylindrical Core (18) extending outward from the center of the Circular Plate (16). The Protruding Cylindrical Core (18) is supported, in cantilever fashion, by the Circular Plate (16). A curved Base Rope Channel (20) extends through the Protruding Cylindrical Core (18). The Base Rope Channel (20) is bounded on its sides by a Base Rope Channel Left Wall (22) and a Base Rope Channel Right Wall (24). The Base Rope Channel (20) is open at the Axle Top Face (26). The Base Rope Channel (20) is of a width and depth such that an entire cross section of a rope can fit within the Base Rope Channel (20). The Protruding Cylindrical Core (18) is sufficiently long so that a Back Axle Portion (28), behind the Base Rope Channel (20) and adjacent to the Circular Plate (16), is entirely solid. The Base Carabiner Attachment Arm (12) extends outward beyond the Circular Plate (16). The outer portion of the Base Carabiner Attachment Arm (12) has a Base Carabiner Hole (30) of sufficient diameter such that a carabiner can be clipped through it. A Base Connecting Pin Hole (32) passes through the Circular Plate (16) and is positioned at an outer point on the Circular Plate (16) generally opposite from the Base Carabiner Hole (30).

The Protruding Cylindrical Core (18) fits within a Central Hole (34) of a Rope Locking Ring (36). The Rope Locking Ring (36) contains an Upper Ring Rope Channel (38) and a Lower Ring Rope Channel (40). When positioned ready for use, the respective inner ends of the Upper Ring Rope Channel (38) and Lower Ring Rope Channel (40) match with the outer ends of the Base Rope Channel (20), forming one continuous channel through which a rope, not shown, may be threaded. When a rope is not present, the Rope Locking Ring (36) can rotate freely around the Protruding Cylindrical Core (18). The width of the Rope Locking Ring (36) is the same dimension as that of the Protruding Cylindrical Core (18). The Upper Ring Rope Channel (38) and Lower Ring Rope Channel (40) have the same depth as the Base Rope Channel (20). Consequently, the back portion of the Rope Locking Ring (36), behind the Upper Ring Rope Channel (38) and Lower Ring Rope Channel (40), is a Continuous Ring (42) of a width that equals the width of the Back Axle Portion (28). The Rope Locking Ring (36) has a Handle (44) extending outward and positioned so as to lie above the Base Carabiner Attachment Arm (12). The Rope Locking Ring (36) also contains a Curved Channel (46), which passes entirely through the width of the Rope Locking Ring (36) and is generally positioned near the edge of the Rope Locking Ring (36) opposite from the Handle (44). Additionally, the Rope Locking Ring (36) contains a Recessed Area (47) in order to minimize weight.

A Cover (48) comprises a Circular Cover Plate (50) from which extends a Cover Carabiner Attachment Arm (52). The Cover Carabiner Attachment Arm (52) has a Cover Carabiner Hole (54) with the same diameter as the Base Carabiner Hole (30). A Cover Connecting Pin Hole (56) passes through the Circular Cover Plate (50) and is positioned on an outer point on the Circular Cover Plate (50) generally opposite from the Cover Carabiner Hole (54).

A Connecting Pin (58) passes through the Base Connecting Pin Hole (32), Curved Channel (46), and Cover Connecting Pin Hole (56). The Curved Channel (46) allows the Connecting Pin (58) to pass through the Rope Locking Ring (36) without interfering with the rotation of the Rope Locking Ring (36) needed to lock the rope.

FIG. 2 presents a view of the Primary Embodiment Belay Device (10) without the Cover (48). This figure illustrates how the internal components fit together.

In operation, a belayer rotates the Cover (48) around the Connecting Pin (58) exposing the Upper Ring Rope Channel (38), Base Rope Channel (20), and Lower Ring Rope Channel (40). A rope, not shown, is threaded through all rope channels with the rope portion toward the belayer entering the device at the outer extreme of the Lower Ring Rope Channel (40), and the rope portion toward the climber exiting the device at the outer extreme of the Upper Ring Rope Channel (38). The Cover (48) is then rotated into a closed position in which the Cover Carabiner Hole (54) is positioned directly in front of the Base Carabiner Hole (30). An open end of a locking carabiner, not shown, is threaded through the belayer's harness, not shown; then through both Base Carabiner Hole (30) and Cover Carabiner Hole (54). The carabiner is then closed and locked.

FIG. 3 presents a view of the Primary Embodiment Belay Device (10), without the Cover (48), as it would appear after the fall of a climber. If a climber falls, the device moves into line with the rope extending from the climber in such a way that a force is exerted on an Upper Ring Rope Channel Left Side (60). This force causes the Rope Locking Ring (36) to begin to rotate in a counter clockwise fashion around the Protruding Cylindrical Core (18). This rotation causes the rope to be pinched in two Rope Pinch Transition Regions (61); one being the transition between the upper left edge of the Lower Ring Rope Channel (40) and the lower right edge of the Base Rope Channel (20), and the other being the transition between the upper left edge of the Base Rope Channel (20) and the lower right edge of the Upper Ring Rope Channel (38). This pinching of the rope causes the rope to stop, thereby stopping the fall of the climber.

After the device has stopped the fall of a climber, the belayer may slowly lower the climber by exerting force on the Handle (44). The Handle (44) is operated so as to slowly rotate the Rope Locking Ring (36) in a clockwise fashion, thereby removing the pinching force on the rope in the two Rope Pinch Transition Regions (61). In order to feed rope out quickly to a climber, the belayer can exert a slight pressure on the Rope Locking Ring (36) while feeding rope, thereby briefly preventing rotation of the Rope Locking Ring (36).

FIG. 4 presents an exploded view of an Alternate Embodiment Belay Device (62). The Alternate Embodiment Belay Device (62) is very similar to the Primary Embodiment Belay Device (10) such that only the differences with the Primary Embodiment Belay Device (10) are discussed herein. Relative to the Primary Embodiment Belay Device (10), upper portions of the Base Rope Channel (20) walls have been removed exposing a Back Axle Portion Front Face (64), and yielding a Base Rope Channel Left Top Surface (66) and a Base Rope Channel Right Top Surface (68). A Rope Locking Arm (70) extends inward from an upper right portion of an Alternate Rope Locking Ring (72), extending above the Base Rope Channel Right Top Surface (68) and covering a right portion of the Back Axle Portion Front Face (64).

FIG. 5 presents a view of the Alternate Embodiment Belay Device (62) without its cover. This figure illustrates how the internal components fit together.

FIG. 6 presents a view of the Alternate Embodiment Belay Device (10), without its cover, as it would appear after the fall of a climber. This Alternate Embodiment Belay Device (62) operates in a similar fashion to the Primary Embodiment Belay Device (10) but provides two advantages. In operation, when the Alternate Rope Locking Ring (72) rotates, the rope is pinched between the Rope Locking Arm (70) and the Base Rope Channel Left Top Surface (66). Relative to the Primary Embodiment Belay Device (10), this Alternate Embodiment Belay Device (62) provides a smaller distance between the axis of rotation for the respective locking ring and the area in which the rope is pinched, thus yielding greater mechanical advantage and a stronger force pinching the rope. Relative to the Primary Embodiment Belay Device (10), this Alternate Embodiment Belay Device (62) also offers a surface at the upper rope pinch point that is less pointy, leading to decreased wear on the rope. FIG. 6 also demonstrates a device in which the length of the Curved Channel (46) has been limited such that the rotation of the Alternate Rope Locking Ring (72) is stopped by the Pin (58) before the Rope Locking Arm (70) can contact the Base Rope Channel Left Top Surface (66). In this manner, the Curved Channel (46) acts as a mechanical stop to prevent excessive forces from being entirely transmitted to the rope at the pinch point. Without such a mechanical stop, excessive forces from a fall could be entirely transmitted to the rope at the pinch point, thus causing the rope to break or fray. With the mechanical stop of the Curved Channel (46), if excessive forces occur during a fall, the rope will slip slightly through the device before coming to a stop.

A very novel and unobvious feature of the subject invention is that the rope actually passes through the axis of rotation of the device. This feature not only yields a smaller and stronger device, but it also allows for the presence of two rope pinch points. Anyone familiar with the physical principle of leverage will realize that, the smaller the distance between the axis of rotation of the device and the rope pinch area, the stronger the grip force of the device. The fact that this device allows the rope to pass through the axis of rotation, yields a device with a very small distance between the axis of rotation and the rope pinch area. This, in turn, yields a device that is both smaller and stronger than those of the prior art. Those prior art auto-locking belay devices that contain rotating parts all have solid axles that form the axis of rotation. Consequently, the rope path in these prior art devices must be directed around these solid rotational axles. Relative to the present invention, these prior art designs result in a larger distance between the axis of rotation and the rope pinch area, thus yielding devices that must be larger than the subject invention in order to achieve the same grip force as the subject invention. Additionally, the fact that the rope path passes through the axis of rotation enables the device to have two rope pinch areas as shown by the two Rope Pinch Transition Regions (61).

The Curved Channel (50) also provides novel and unobvious functionality. This feature not only yields a relatively small device, it prevents excessive forces from damaging the rope. The Curved Channel (50) allows the Connecting Pin (58), which connects the Base (14) and Cover (50), to reside within the dimensions of the Rope Locking Ring (36) without interfering with the rotation of the Rope Locking Ring (36). Without this Curved Channel (50), the Connecting Pin (58) would have to reside outside of the dimensions of the Rope Locking Ring (36), yielding a larger Base (14) and Cover (50), thereby requiring a larger device. The Curved Channel (50) can also be dimensioned to form a mechanical stop. In this configuration, rotation of the Rope Locking Ring is stopped when the Curved Channel (50) contacts the Connecting Pin (58), thus preventing excessive forces from being entirely transmitted to the rope at the rope pinch point. This feature increases safety by ensuring that the rope will not break or be damaged by such extreme forces.

CONCLUSION, RAMIFICATIONS, AND SCOPE

Thus the reader will see that the improved belay device of the invention provides a rugged economical device that optimizes the desired performance characteristics. The improved belay device is simple in design, highly effective, and is simple to operate. With respect to the sport of rock climbing, it can function either as a belay device or as a descender. It can also be used in a variety of situations to lower an object in a controlled fashion.

While the above description contains many specifics, these should not be construed as limitations on the scope of the invention, but rather as exemplification of two embodiments thereof. Each piece described within the aforementioned embodiments could be changed in form in ways that would not affect its function. Accordingly, the scope of the invention should be determined not by the embodiments illustrated, but by the appended claims and their legal equivalents.

The embodiments of the invention for which an exclusive privilege and property right are claimed are defined as follows:

1. A device used, in conjunction with a rope, to control the movement of a weight attached to said rope, comprising:

a) a base plate with a protruding cylindrical core and an attachment means; said protruding cylindrical core being supported in cantilever fashion by said base plate and containing a base rope channel through which a rope may be threaded; said base rope channel extending through said protruding cylindrical core and being open at a front face of said protruding cylindrical core; a back portion of said protruding cylindrical core, behind said base rope channel, forming a continuous cylinder; said base rope channel being positioned so as to pass though an axis of rotation of said device; said attachment means enabling said device to be attached either to a belayer's harness or to a fixed anchor point, b) a rope locking ring with a controlled release means; said rope locking ring containing a central opening, an upper rope channel through which said rope may be threaded, and a lower rope channel through which said rope may be threaded; said central opening being dimensioned so as to receive said protruding cylindrical core; said upper rope channel passing through an upper portion of said rope locking ring; said lower rope channel passing through a lower portion of said rope locking ring; both said upper rope channel and said lower rope channel being open at a front surface of said rope locking ring; said lower rope channel, said upper rope channel, and said base rope channel forming one continuous rope channel through said device when said device is in a normal operating configuration; said rope locking ring further containing a continuous ring portion, behind said upper rope channel and said lower rope channel, for integrity; said rope causing said rope locking ring with said controlled release means to rotate with respect to said protruding cylindrical core in an event that said rope begins to move quickly through said device such as in the case of a fall by a climber; rotation of said rope locking ring causing said rope to be pinched at two rope channel transition regions between said lower rope channel, said base rope channel, and said upper rope channel; exertion of force on said controlled release means after said device has locked said rope causing said rope locking ring to rotate in a direction that causes the release of the pinch on said rope in said two rope channel transition regions, c) a cover with a cover closure means and a cover rotation means; said cover dimensioned and positioned such that in said normal operating configuration said cover sufficiently blocks a front opening of said continuous rope channel such that said rope cannot come free from said device; said cover rotation means allowing said cover to be rotated into a position exposing said continuous rope channel so that said rope may be threaded through said device, then rotated back into said normal operating configuration; said closure means allowing said cover to be secured in said normal operating configuration, d) a connecting means allowing said base with said rope locking ring to be joined to said cover in a manner which does not interfere with the required rotation of said rope locking ring.

2. The device of claim 1 wherein said attachment means comprises a carabiner attachment arm with a carabiner attachment hole; said carabiner attachment arm extending beyond the profile of said rope locking ring when said device is in said normal operating configuration; said carabiner attachment hole extending through said carabiner attachment arm and dimensioned so a to receive a carabiner for attachment purposes.

3. The device of claim 1 wherein said controlled release means comprises a handle attached to said rope locking ring and extending outward from said rope locking ring.

4. The device of claim 1 wherein said cover closure means comprises a cover carabiner hole extending through said cover, said cover carabiner hole being aligned with said carabiner attachment hole when said device is in said normal operating configuration, such that said carabiner may be clipped through both said carabiner attachment hole and said cover carabiner hole.

5. The device of claim 1 wherein said connecting means comprises a base pin hole, a pin, and a cover pin hole; said base pin hole extending through said base and being positioned roughly opposite from said attachment means, said base pin hole further being dimensioned so as to receive said pin; said cover pin hole extending through said cover and being positioned so as to align with said base pin hole, said cover pin hole further being dimensioned so as to receive said pin, said pin extending through both said base pin hole and said cover pin hole.

6. The device of claim 5 wherein said cover rotation means comprises said pin and said cover pin hole; said cover being able to rotate with respect to said pin.

7. The device of claim 5 further containing a curved channel; said curved channel extending through said rope locking ring and being positioned such that said pin extends through said curved channel; the curvature of said curved channel being such that said pin does not interfere with the rotation of said rope locking ring required to lock said rope; said curved channel allowing said pin to be positioned within the extents of said rope locking ring thereby allowing for said device to be relatively small.

8. The device of claim 7 wherein said curved channel further provides a mechanical stop, the length of said curved channel being set such that upon rotation of said rope locking ring said pin contacts an upper wall of said curved channel, thus stopping further rotation of said rope locking ring; said length of said curved channel being set such that said rotation of said rope locking ring is stopped before said rope is excessively pinched in said rope channel transition regions; said mechanical stop thereby preventing excessive forces, which might damage said rope, from being fully transmitted to said rope at the pinch points of said rope in said rope channel transition regions, while still allowing sufficient forces to lock said rope.

9. A device used, in conjunction with a rope, to control the movement of a weight attached to said rope, comprising:

a) a base plate with a protruding cylindrical core and an attachment means; said protruding cylindrical core being supported in cantilever fashion by said base plate and containing a base rope channel through which a rope may be threaded; said base rope channel extending through said protruding cylindrical core and being open at a front face of said protruding cylindrical core; a back portion of said protruding cylindrical core, behind said base rope channel, forming a continuous cylinder; the walls of said base rope channel extending upward less than the full diameter of said protruding cylindrical core thus exposing an upper portion of a front face of said continuous cylinder in a region above said walls of said base rope channel, along with a base rope channel left wall top portion and a base rope channel right wall top portion; said base rope channel being positioned so as to pass though an axis of rotation of said device; said attachment means enabling said device to be attached either to a belayer's harness or to a fixed anchor point, b) a rope locking ring with a controlled release means; said rope locking ring containing a central opening, an upper rope channel through which said rope may be threaded, and a lower rope channel through which said rope may be threaded; said central opening being dimensioned so as to receive said protruding cylindrical core; a back portion of said central opening being circular in cross section, a front portion of said central opening having a cross section which is a partial circle interrupted by a portion protruding inward from a side of said rope locking ring; said portion protruding inward from a side of said rope locking ring thus forming a rope locking arm; said rope locking arm being positioned and dimensioned such that in a normal operating configuration a back face of said rope locking arm resides just to the front of a right side of said upper portion of a front face of said continuous cylinder, and a bottom face of said rope locking arm residing just above said base rope channel right wall top portion; said upper rope channel passing through an upper portion of said rope locking ring; said lower rope channel passing through a lower portion of said rope locking ring; both said upper rope channel and said lower rope channel being open at a front surface of said rope locking ring; said lower rope channel, said upper rope channel, and said base rope channel forming one continuous rope channel through said device when said device is in a normal operating configuration; said rope locking ring further containing a continuous ring portion, behind said upper rope channel and said lower rope channel, for integrity; said rope causing said rope locking ring with said controlled release means to rotate with respect to said protruding cylindrical core in an event that said rope begins to move quickly through said device such as in the case of a fall by a climber, rotation of said rope locking ring causing said rope to be pinched at two rope pinch regions, a lower rope pinch region being the transition region between said lower rope channel and said base rope channel, an upper rope pinch region being the region between said rope locking arm and said base rope channel left wall top portion; exertion of force on said controlled release means after said device has locked said rope causing said rope locking ring to rotate in a direction that causes the release of the pinch on said rope in said two rope pinch regions, c) a cover with a cover closure means and a cover rotation means; said cover dimensioned and positioned such that in said normal operating configuration said cover sufficiently blocks a front opening of said continuous rope channel such that said rope cannot come free from said device; said cover rotation means allowing said cover to be rotated into a position exposing said continuous rope channel so that said rope may be threaded through said device, then rotated back into said normal operating configuration; said closure means allowing said cover to be secured in said normal operating configuration, d) a connecting means allowing said base with said rope locking ring to be joined to said cover in a manner which does not interfere with the required rotation of said rope locking ring.

10. The device of claim 9 wherein said attachment means comprises a carabiner attachment arm with a carabiner attachment hole; said carabiner attachment arm extending beyond the profile of said rope locking ring when said device is in said normal operating configuration; said carabiner attachment hole extending through said carabiner attachment arm and dimensioned so a to receive a carabiner for attachment purposes.

11. The device of claim 9 wherein said controlled release means comprises a handle attached to said rope locking ring and extending outward from said rope locking ring.

12. The device of claim 9 wherein said cover closure means comprises a cover carabiner hole extending through said cover, said cover carabiner hole being aligned with said carabiner attachment hole when said device is in said normal operating configuration, such that said carabiner may be clipped through both said carabiner attachment hole and said cover carabiner hole.

13. The device of claim 9 wherein said connecting means comprises a base pin hole, a pin, and a cover pin hole; said base pin hole extending through said base and being positioned roughly opposite from said attachment means, said base pin hole further being dimensioned so as to receive said pin; said cover pin hole extending through said cover and being positioned so as to align with said base pin hole, said cover pin hole further being dimensioned so as to receive said pin, said pin extending through both said base pin hole and said cover pin hole.

14. The device of claim 13 wherein said cover rotation means comprises said pin and said cover pin hole; said cover being able to rotate with respect to said pin.

15. The device of claim 13 further containing a curved channel; said curved channel extending through said rope locking ring and being positioned such that said pin extends through said curved channel; the curvature of said curved channel being such that said pin does not interfere with the rotation of said rope locking ring required to lock said rope; said curved channel allowing said pin to be positioned within the extents of said rope locking ring thereby allowing for said device to be relatively small.

16. The device of claim 15 wherein said curved channel further provides a mechanical stop, the length of said curved channel being set such that upon rotation of said rope locking ring said pin contacts an upper wall of said curved channel, thus stopping further rotation of said rope locking ring; said length of said curved channel being set such that said rotation of said rope locking ring is stopped before said rope is excessively pinched in said rope pinch regions; said mechanical stop thereby preventing excessive forces, which might damage said rope, from being fully transmitted to said rope at the pinch points of said rope in said rope pinch regions, while still allowing sufficient forces to lock said rope.

* * * * *